US007260354B2

(12) United States Patent
Ishida

(10) Patent No.: US 7,260,354 B2
(45) Date of Patent: Aug. 21, 2007

(54) IMAGE FORMING METHOD

(75) Inventor: Yoshiku Ishida, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/304,814

(22) Filed: Dec. 16, 2005

(65) Prior Publication Data

US 2006/0133871 A1 Jun. 22, 2006

(30) Foreign Application Priority Data

Dec. 20, 2004 (JP) ..... 2004-367348

(51) Int. Cl.
*G03G 15/00* (2006.01)

(52) U.S. Cl. ..... 399/409; 399/341; 399/407; 399/408

(58) Field of Classification Search ..... 399/341, 399/407, 408, 409
See application file for complete search history.

(56) References Cited

U.S. PATENT DOCUMENTS 5,213,560 A * 5/1993 Crowley ..... 493/231
5,361,089 A * 11/1994 Bearss et al. ..... 347/119
5,486,436 A * 1/1996 Lakes ..... 430/11
6,394,728 B1 * 5/2002 Boss ..... 412/1
6,459,880 B1 * 10/2002 Russell ..... 399/408
6,980,767 B1 * 12/2005 Cahill et al. ..... 399/408

FOREIGN PATENT DOCUMENTS

JP 61-274764 12/1986
JP 9-110051 4/1997
JP 2004093819 A * 3/2004
JP 2004-126229 4/2004

* cited by examiner

*Primary Examiner*—David M. Gray
*Assistant Examiner*—Erika J. Villaluna
(74) *Attorney, Agent, or Firm*—Fitzpatrick, Cella, Harper & Scinto

(57) ABSTRACT

Using an adhesive toner that is lower in a lower-limit temperature of a fixable temperature than an image forming toner, the image forming toner and the adhesive toner are formed on one and the same transfer material. A document is sealed by an adhesive force of the adhesive toner, at a temperature at which the image forming toner develops no adhesive force.

5 Claims, 8 Drawing Sheets

IMAGE FORMING METHOD

BACKGROUND OF THE INVENTION

1. Field of the Invention

The present invention relates to an image forming method for a copier, a printer, or the like, in which an adhesive portion is formed on a recording material using an electrophotographic process with the aid of an adhesive toner having a function as an adhesive for the sealing of a document or the like as well as an image forming toner.

2. Related Background Art

Conventionally, when a document with confidential contents requiring sealing, such as a pay statement is produced, a preprinted sheet is prepared, on which a format such as ruled lines is printed by a printing machine, and a pressure bonding adhesive for sealing is applied to an adhesive portion of the preprinted sheet. Only recorded data such as letters, and numbers are variably outputted using an electrophotographic apparatus. After that, the preprinted sheet is folded and contact-bonded by a post-treatment device, and the document is thereby sealed. This method has been widely adopted.

However, there are problems in that it takes a long time to prepare the preprinted sheet having formed thereon the format by the printing machine and the adhesive portion by the adhesive, and in that high cost and low efficiency are inevitable in a field of application requiring a small number of preprinted sheets.

In view of the above-mentioned problems, JP S61-274764 A and JP H09-110051 A each discloses a method of sealing a document. According to this method, with the aid of an electrophotographic process, a format is formed and an adhesive portion is formed using a toner for forming recorded data as an adhesive. The adhesive portion is heated and pressurized to soften the toner to develop adhesiveness. As a result, the document is sealed.

Further, JP 2004-126229 A discloses a method for sealing a document by adding a pressure sensitive adhesive to a toner, forming an adhesive portion by an electrophotographic apparatus, and bonding the adhesive portion by the application of a pressure by a pressure bonding device.

However, due to heat and pressure at the time of adhesion, the toner forming an image as well as the toner serving as an adhesive develops adhesiveness, and part of the toner image is transferred onto a surface of the sheet opposed thereto when the toner used to form the image is used as the adhesive. As a result, the toner image deteriorates. Therefore, only the adhesive portion needs to be heated and pressurized locally, which requires a special post-treatment device or a manual operation step. Thus, problems are caused in terms of the cost of the device and the efficiency.

The method of using toner to which a pressure sensitive adhesive is added requires a large-sized pressure bonding device as a post-treatment device, so problems are caused in terms of the space and cost of the device.

SUMMARY OF THE INVENTION

The present invention has been made in view of the above-mentioned problems. It is therefore an object of the present invention to provide an image forming apparatus for producing a document to be sealed at low cost and with high efficiency without employing any special post-treatment device.

According to the present invention capable of achieving the above-mentioned object, an image forming method includes the steps of:

forming an image on a recording material using an image forming toner;

heat fixing the image on the recording material which has been formed using the image forming toner;

forming an image on the recording material using an adhesive toner that is lower in lower-limit temperature of a fixable temperature than the image forming toner; and heat fixing the image on the recording material which has been formed using the adhesive toner.

DESCRIPTION OF THE PREFERRED EMBODIMENTS

The embodiments of the present invention will be described hereinafter with reference to the drawings.

First Embodiment

Figure 1:
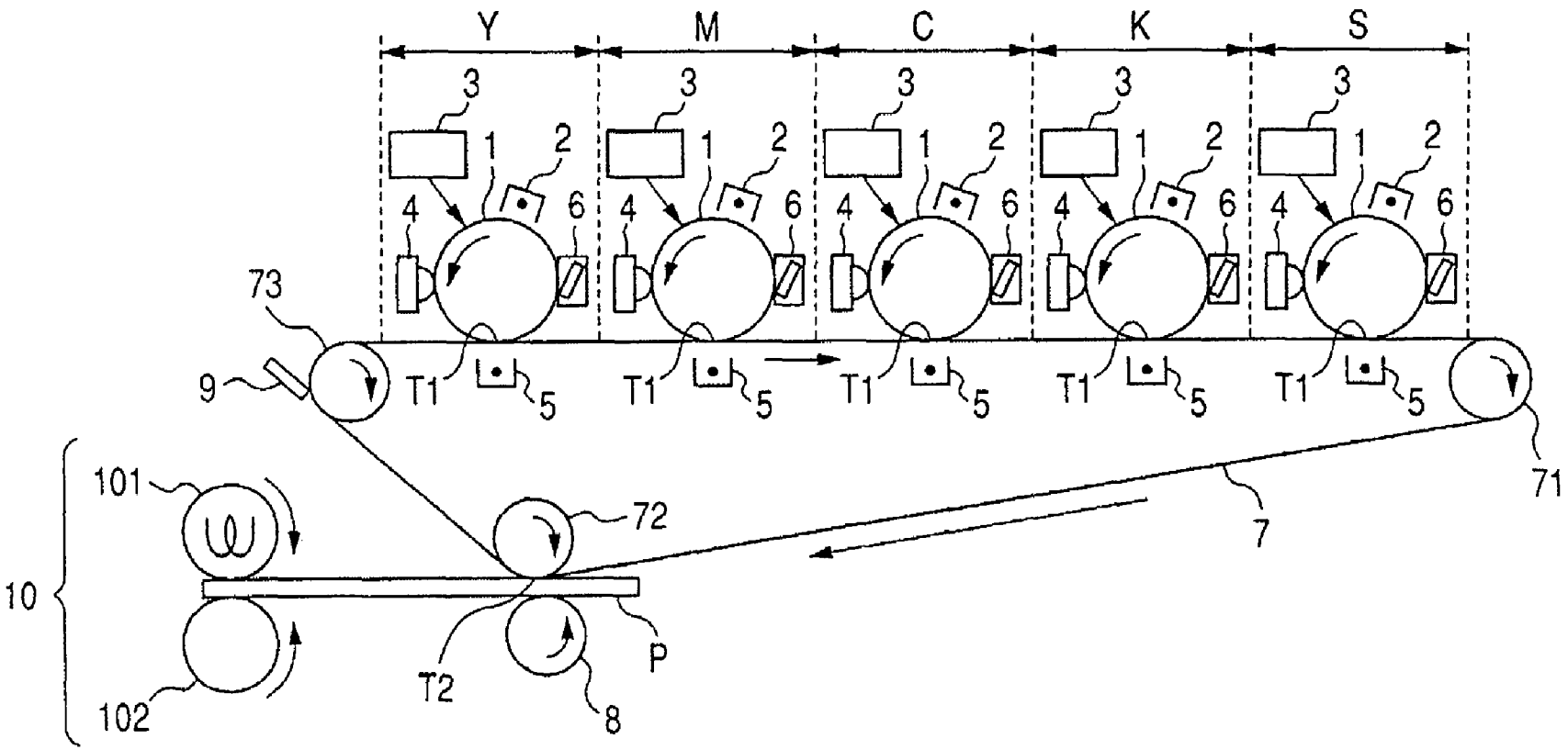
FIG. 1 is a longitudinal sectional view showing the outline of a construction of an image forming apparatus according to a first embodiment of the present invention.
Figure 2:
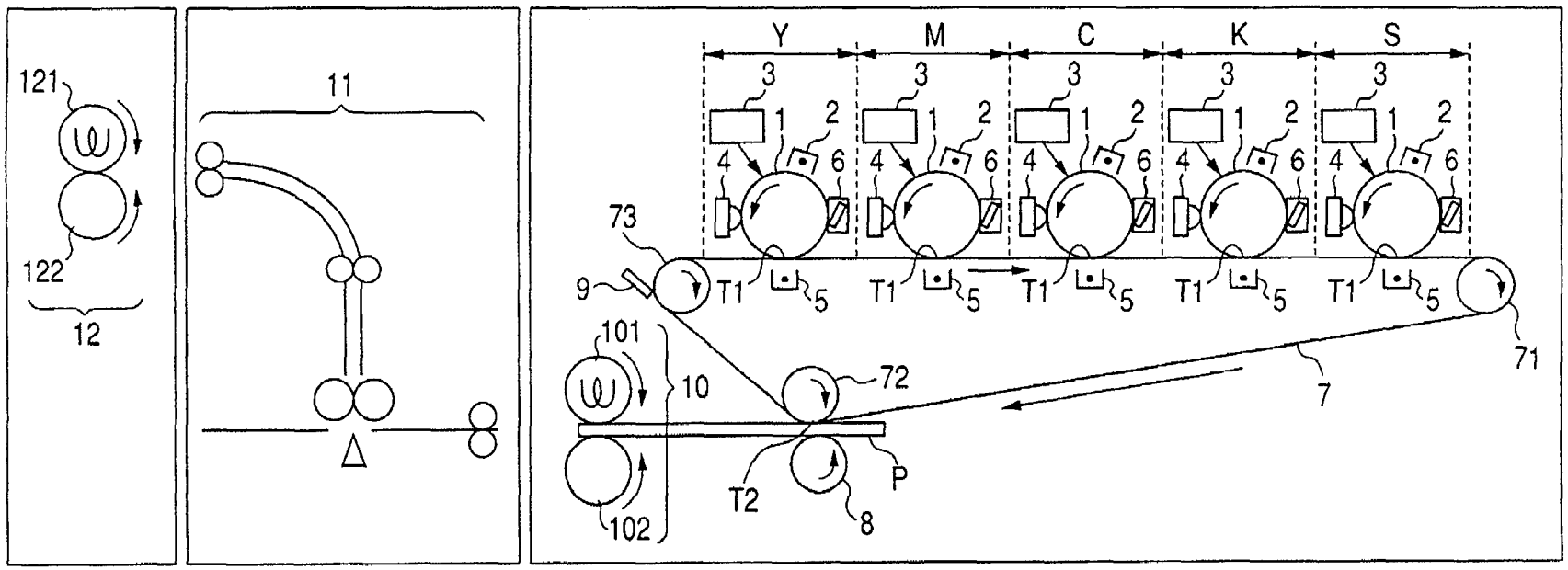
FIG. 2 is a longitudinal sectional view showing the outline of a system configuration of the image forming apparatus according to the first embodiment of the present invention.

FIGS. 1 and 2 are each a longitudinal sectional view of an example of an image forming apparatus according to the present invention.

The image forming apparatus shown in FIGS. 1 and 2 is a full-color image forming apparatus equipped with an automatic duplex printing mechanism (not shown), in which five image forming units Y, M, C, K, and S are arranged along a moving direction of an intermediate transfer belt 7 as an intermediate transfer member. A two-component non-magnetic negative chargeable toner with an average particle diameter of 6 μm is used for this image forming apparatus.

The image forming apparatus shown in FIGS. 1 and 2 is provided with four image forming units for forming toner images in different colors, namely, the image forming units Y, M, C, and K for forming yellow, magenta, cyan, and black toner images, respectively. The image forming apparatus is further provided with the image forming unit S. This image forming unit S is provided for a special-function toner such as a toner for forming a color that cannot be reproduced by combining yellow, magenta, cyan, and black toners of the image forming apparatus, a special-color toner for reproducing a color with a strictly prescribed tone as in the case of a corporate logo, and a transparent toner for controlling the glossiness of an image or protecting an image, etc. In this embodiment, the image forming unit S is employed for an adhesive toner. The image forming units Y, M, C, K, and S are substantially identical in construction and operation as long as their electrophotographic processes are concerned, except that their toners are different from one another.

First of all, a toner used in this embodiment will be described. Note that, a known magnetic carrier is employed.

An image forming toner is composed of 100 parts by weight of polyester resin, 6 parts by weight of paraffin wax, 2.0 parts by weight of a known negative chargeable charge control agent, and 1.5 parts by weight of negative chargeable hydrophobic silica, and is obtained by blending known respective pigments of black, magenta, cyan, and yellow in respective amounts required for maintaining the optical density of a fixed image. The toner is manufactured according to a known manufacturing method. In the image forming apparatus according to this embodiment, the image forming toner has a fixable temperature of 160° C. to 190° C. as to each of the colors.

The fixable temperature mentioned above is expressed as a surface temperature of a fixing roller, which is between an upper-limit temperature for offsetting the fixing roller at high temperatures and a lower-limit temperature for satisfying the fixability of a toner to a transfer material at low temperatures.

The fixability is evaluated by abrasively sliding a sheet of lens-cleaning paper, to which a load of 50 g/cm$^2$ is applied, on a toner image on a fixed transfer material five times in a reciprocating manner, and measuring a decreasing rate between reflection densities of the toner image before and after the abrasive sliding, and the lower-limit temperature of the fixable temperature is set as 20% of the decreasing rate in the reflection density. Although the fixablity is a value representing an adhesive force of the toner to the transfer material, it is also related to an adhesive force acting among toners.

As regards the adhesive toner, the amount of paraffin wax is increased to 12 parts by weight in order to improve a softening property at low temperatures and offset resistance at high temperatures, and the amount of negative chargeable hydrophobic silica is increased to 5.0 parts by weight in order to compensate for a deterioration in blocking resistance and a deterioration in fluidity resulting from the increase in the amount of paraffin wax and further improve offset resistance at high temperatures. The components other than the pigments are identical to those of the image forming toner. In the image forming apparatus according to this embodiment, the adhesive toner has a fixable temperature of 110° C. to 190° C.

Although the reproducibility of a latent image on the photosensitive member has deteriorated due to the increased amounts of paraffin wax and negative chargeable hydrophobic silica, there is no problem in forming an adhesive toner image on an adhesive portion of the transfer material.

Next, the construction of the image forming apparatus according to this embodiment will be described.

In each of the image forming units Y, M, C, K, and S, reference numeral 1 denotes a drum-shaped electrophotographic photosensitive member (hereinafter referred to as photosensitive member) serving as an image bearing member. The photosensitive member 1 is rotationally driven by drive means (not shown) in a direction indicated by the arrow (counterclockwise). A photoconductive layer is provided on a conductive base layer to constitute the photosensitive member 1. An organic photoconductor (OPC), an amorphous silicon photoconductor, a selenium photoconductor, or the like can be used as the photosensitive member 1. In this embodiment, an organic photoconductor (OPC) is used.

A charge means 2 uniformly charges the surface of the photosensitive member 1 to a predetermined polarity and a predetermined potential. A scorotron charging device, a charging roller, a magnetic brush, or the like can be used as the charge means 2. In this embodiment, a scorotron charging device is used to charge the photosensitive member 1 to a predetermined potential of a negative polarity.

An exposure means 3, which is provided downstream of the charge means 2 in a rotational direction of the photosensitive member 1, optically scans a surface of the photosensitive member 1 uniformly charged by the charge means 2, thereby forming an electrostatic latent image on the photosensitive member 1. A laser scanner, an LED array, or the like can be used as the exposure means 3. In this embodiment, a laser scanner is used.

A developing device 4, which is arranged downstream of the exposure means 3 in the rotational direction of the photosensitive member 1, develops the electrostatic latent image on the photosensitive member 1 with a toner. In this embodiment, the electrostatic latent image on the photosensitive member 1 is reverse-developed by the above-mentioned two-component nonmagnetic negative chargeable toner.

A primary transfer means 5, which is provided so as to be opposite to the photosensitive member 1 with an intermediate transfer belt 7 interposed therebetween at a primary transfer position T1, primarily transfers a toner image on the photosensitive member 1 onto the intermediate transfer belt 7 by a transfer electric field of the primary transfer means 5. A scorotron transfer charging device, a transfer roller, a transfer blade, a transfer brush, or the like can be used as the primary transfer means 5. In this embodiment, a scorotron transfer charging device is used, and the toner image on the photosensitive member 1 is primarily transferred onto the intermediate transfer belt 7 by a positive transfer electric field.

A photosensitive member cleaning means 6 removes from the surface of the photosensitive member 1 a transfer residual toner that has not been transferred onto the intermediate transfer belt 7 by the primary transfer means 5. A cleaning blade, a brush roller, or the like can be used as the photosensitive member cleaning means 6. In this embodiment, a cleaning blade is used, which is made of a urethane material having a durometer A hardness of 70 and a thickness of 3 mm.

The aforementioned operation is performed in each of the five image forming units Y, M, C, K, and S. A yellow toner image formed by the image forming unit Y, a magenta toner image formed by the image forming unit M, a cyan toner image formed by the image forming unit C, a black toner image formed by the image forming unit K, and an adhesive toner image formed by the image forming unit S are sequentially superimposed at primary transfer portions T1 of the respective image forming units and then primarily transferred onto the intermediate transfer belt 7. Thus, an unfixed full-color toner image composed of the respective superimposed images, that is, the yellow, magenta, cyan, and black toner images is synthetically formed on the intermediate transfer belt 7. Also, the adhesive toner image is formed on the intermediate transfer belt 7.

The intermediate transfer belt 7 as an intermediate transfer member, which is suspended by a driving roller 71 and driven rollers 72 and 73 and is in contact with the photosensitive members 1 of the respective image forming units Y, M, C, K, and S, is rotationally driven in the direction indicated by the arrow.

For the intermediate transfer belt 7, a resin such as polyester, fluororesin, polyphenylene sulfide, polyamide-imide, polyimide, polyether ketone or polycarbonate can be used. As an electric resistance, the intermediate transfer belt 7 preferably exhibits a volume resistivity of $10^6$ to $10^{13}$ Ω·cm and a surface resistivity of $10^8$ to $10^{14}$ Ω/□, and more preferably exhibits a volume resistivity of $10^8$ to $10^{11}$ Ω·cm and a surface resistivity of $10^{10}$ to $10^{13}$ Ω/□. In this embodiment, an endless polyimide belt with a thickness of 90 μm, of which an electric resistance has been adjusted to a volume resistivity of $10^9$ Ω·cm and a surface resistivity of $10^{11}$ Ω/□ according to a known method, is used. In an environment with a temperature of 23° C. and a relative humidity of 50% RH, the electric resistance of the intermediate transfer belt 7 was measured under the condition of an applied voltage of 100 V and a charging time of 10 seconds, using a measuring instrument R8340A manufactured by ADVANTEST CORPORATION and a probe having a main electrode with an outer diameter of 50 mm and a guard electrode with an inner diameter of 70 mm.

A secondary transfer means 8 is provided so as to be opposed to the driven roller 72 across the intermediate transfer belt 7 at a secondary transfer position T2. The toner image on the intermediate transfer belt 7 is secondarily transferred onto a transfer material P that has been introduced from a paper feeding portion (not shown) to the secondary transfer position T2 in exact timing with the toner image on the intermediate transfer belt 7, by a transfer electric field of the secondary transfer means 8. A scorotron transfer charging device, a transfer roller, a transfer blade, a transfer brush, or the like can be used as the secondary transfer means 8. In this embodiment, a transfer roller having a semi-conductive foamed rubber layer formed on a metal shaft is used, and the toner image on the intermediate transfer belt 7 is secondarily transferred onto the transfer material P by a positive transfer electric field.

The intermediate transfer belt cleaning means 9 removes the transfer residual toner that has remained instead of being transferred onto the transfer material on the intermediate transfer belt 7. A cleaning roller, a cleaning blade, a cleaning web, or the like can be used as the intermediate transfer belt cleaning means 9. In this embodiment, a cleaning blade is used, which is made of a urethane material having a durometer A hardness of 75 and a thickness of 2 mm.

The fixing means 10 heats and pressurizes the toner image on the transfer material, thereby fixing the toner image onto the transfer material.

As each of a fixing roller 101 and a pressurizing roller 102, rollers having a metal roller on which an elastic layer made of fluororubber, silicone rubber, or the like and a surface layer made of a material exhibiting a high mold-releasing property for toner, for example, fluororesin such as PFA or PTFE, or silicone resin, being laminated can be used. A heater is provided inside the fixing roller 101 to control the temperature therein. In this embodiment, a fixing device is constituted by the fixing roller 101 and the pressurizing roller 102, each having an outer diameter of 60 mm. The fixing roller 101 and the pressurizing roller 102 are each constructed as a hollow roller made of an aluminum alloy on which an elastic layer made of silicone rubber having a thickness of 2 mm and a surface layer made of PFA having a thickness of 50 μm are laminated. A halogen lamp is arranged inside the fixing roller 101 as the heater, and a surface temperature sensor (not shown) is employed to detect and control a surface temperature.

A two-folding device 11, which is connected on-line to the image forming apparatus, folds the fixed transfer material P at a designated position such that a toner conveyed from the image forming apparatus is formed and that a surface of the transfer material P on which an adhesive portion is formed by the adhesive toner is positioned inside. In this embodiment, a known two-folding device is used.

A close sealing device 12 heats and pressurizes the transfer material P of which the surface on which the adhesive portion has been formed by the adhesive toner has been folded inward by the two-folding device 11, thereby adhering the adhesive portion. The close sealing device 12 according to this embodiment is required to perform the same function as the fixing device of the image forming apparatus. In this embodiment, the fixing means 10 of the image forming apparatus is used as the close sealing device 12 as well.

Figure 3B:
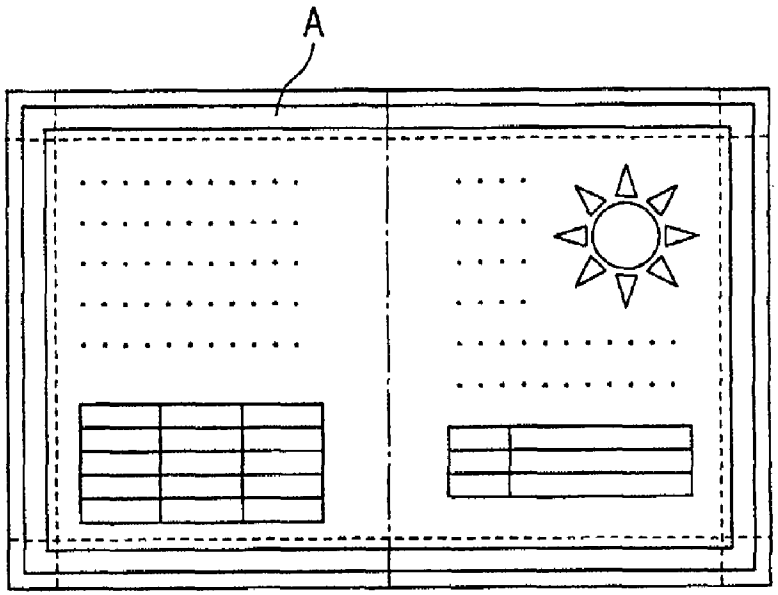
FIGS. 3A and 3B each shows the outline of an estimate sheet of insurance according to the first embodiment of the present invention.
Figure 3A:
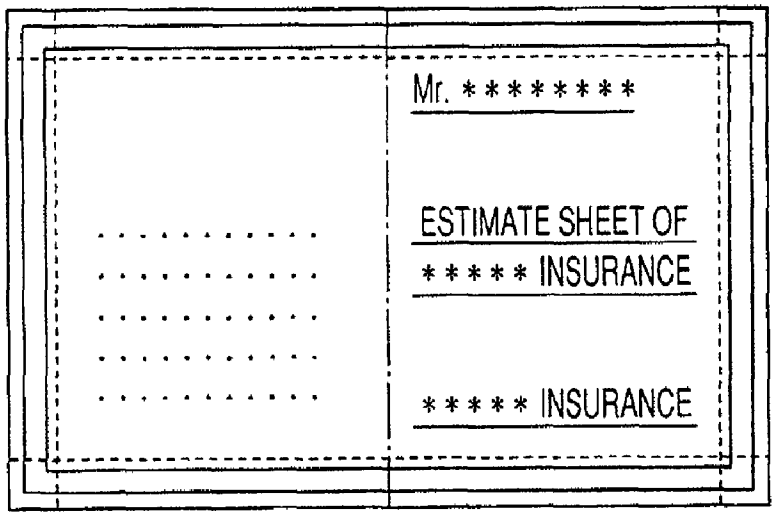
Figure 4:
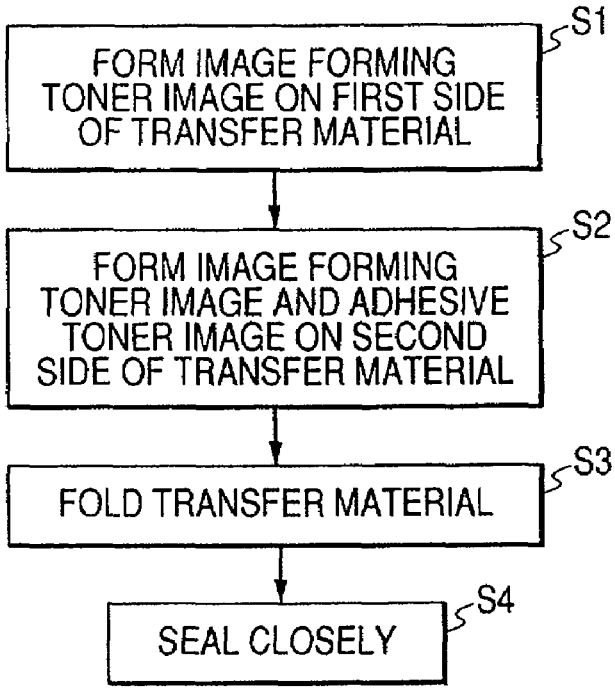
FIG. 4 is a flowchart showing the outlines of image forming method according to the first embodiment and a third embodiment of the present invention.

Now, an image forming method in the image forming apparatus equipped with the above-mentioned automatic duplex printing mechanism will be described based on steps shown in FIG. 4, with reference to the preparation of an estimate sheet of insurance shown in FIGS. 3A and 3B as an example.

In a step S1, an image forming toner image is formed on the first side (FIG. 3A) of a transfer material based on electronic image information. In this embodiment, an address, a corporate name, and the like are printed.

In a step S2, an image forming toner image and an adhesive toner image are formed on the second side (FIG. 3B) of the transfer material based on electronic image information. In this embodiment, the contents of the estimate sheet of insurance are printed, and an adhesive portion A is formed by the adhesive toner.

The adhesive toner is made to exhibit the property of softening at a lower temperature than the image forming toner, but is substantially identical to the image forming toner in the property of offsetting the fixing roller at high temperatures due to the effect of the increased amounts of paraffin wax and negative chargeable hydrophobic silica. Therefore, the adhesive toner can be fixed at the same temperature of the fixing roller as the image forming toner. In this embodiment, the temperature of the fixing roller is set to 180° C.

In a step S3, the transfer material is folded. After the toner is fixed, the transfer material is conveyed to the two-folding device 11 with the surface on which the adhesive toner image is formed facing downward by a surface reversing device (not shown), and then is folded such that the surface on which the adhesive toner image is formed is positioned inside. In this embodiment, the transfer material is folded along an alternate long and short dash line at the center of the estimate sheet of insurance such that the adhesive portion A is positioned inside.

In a step S4, the transfer material is sealed. The folded transfer material is conveyed to the close sealing device 12 and heated, so the adhesive toner develops adhesiveness. The transfer material is then sealed by being pressurized. The temperature most suited for sealing differs depending on the required adhesive force or the heat capacity of paper, so the temperature of the fixing roller in the close sealing device 12 can be set again in a control portion of a main body. In this embodiment, this temperature is set to 125° C.

The estimate sheet of insurance produced according to the above-mentioned method is adhesively sealed on the adhesive portion A, and can be opened by cutting the adhesive portion A off along perforations. The toner image produced by the image forming toner undergoes no image deterioration such as offset to an opposite surface, deformation of the toner image, or the like.

In this embodiment, the adhesive portion A is formed on the second side by the adhesive toner. However, it is also possible to form the adhesive toner image on the first side.

Second Embodiment

Figure 5:
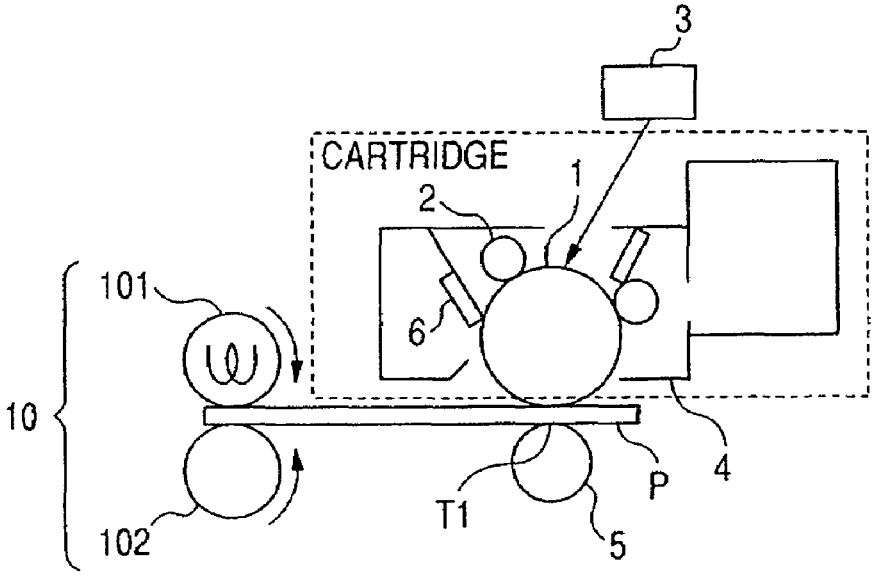
FIG. 5 is a longitudinal sectional view showing the outline of a construction of an image forming apparatus according to a second embodiment of the present invention.

FIG. 5 is a longitudinal sectional view of an example of an image forming apparatus according to the present invention.

An image forming apparatus shown in FIG. 5 is a monochrome image forming apparatus equipped with a so-called cartridge-type automatic duplex printing mechanism (not shown), in which a photosensitive member 1, a charge means 2, a developing device 4, a photosensitive member cleaning means 6, and a toner container are integrated into a replaceable cartridge. A one-component magnetic negative chargeable toner with an average particle diameter of 7 μm is used for this image forming apparatus.

First of all, a toner used in this embodiment will be described.

An image forming toner is composed of 100 parts by weight of styrene resin, 5 parts by weight of paraffin wax, 80 parts by weight of magnetite, 2.0 parts by weight of a known negative chargeable charge control agent, and 1.5 parts by weight of negative chargeable hydrophobic silica, and is obtained by known manufacturing method. In the image forming apparatus according to this embodiment, the image forming toner has a fixable temperature of 160° C. to 200° C.

An adhesive toner is obtained by blending 10 parts by weight of a known hot-melt adhesive in order to improve the softening property at low temperatures and increasing the amount of negative chargeable hydrophobic silica to 3.0 parts by weight in order to compensate for a deterioration in blocking resistance and a deterioration in fluidity resulting from the blending of the hot-melt adhesive and enhance the offset resistance at high temperatures. The other components of the adhesive toner are the same as those of the image forming toner. In the image forming apparatus according to this embodiment, this adhesive toner has a fixable temperature of 130° C. to 160° C. Although the reproducibility of a latent image on the photosensitive member has deteriorated due to the blending of the hot-melt adhesive and the increased amount of negative chargeable hydrophobic silica, there is no problem in forming an adhesive toner image on an adhesive portion of the transfer material.

Next, the construction of the image forming apparatus according to this embodiment will be described.

The photosensitive member 1 as an image bearing member is rotationally driven by drive means (not shown) in a direction indicated by an arrow (clockwise). A photoconductive layer is provided on a conductive base layer to constitute the photosensitive member 1. An organic photoconductor (OPC), an amorphous silicon photoconductor, a selenium photoconductor, or the like can be used as the photosensitive member 1. In this embodiment, an organic photoconductor (OPC) is used.

The charge means 2 uniformly charges the surface of the photosensitive member 1 to a predetermined polarity and a predetermined potential. A scorotron charging device, a charging roller, a magnetic brush, or the like can be used as the charge means 2. In this embodiment, a charging roller, which is obtained by forming a conductive foamed rubber layer on a metal shaft and sequentially applying thereto a dielectric layer with a thickness of 300 μm and a protective layer with a thickness of 10 μm, is used to charge the photosensitive member 1 to a predetermined potential of a negative polarity.

An exposure means 3, which is provided downstream of the charge means 2 in a rotational direction of the photosensitive member 1, optically scans a surface of the photosensitive member 1 uniformly charged by the charge means 2, thereby forming an electrostatic latent image on the photosensitive member 1. A laser scanner, an LED array, or the like can be used as the exposure means 3. In this embodiment, a laser scanner is used.

The developing device 4, which is arranged downstream of the exposure means 3 in the rotational direction of the photosensitive member 1, develops an electrostatic latent image on the photosensitive member 1 by toner. In this embodiment, the electrostatic latent image on the photosensitive member 1 is reverse-developed by the above-mentioned one-component magnetic negative chargeable toner according to a so-called magnetic jumping development method in which a thin-layer toner is held on a developing sleeve serving as a rotating toner bearing member having magnetic field generating means inside the developing device 4 and is caused to fly onto the photosensitive member 1 at a position opposed to the photosensitive member 1 in a non-contacting state by an alternating-current bias on which a direct-current (DC) voltage applied to the developing sleeve is superimposed.

A transfer means 5, which is provided at a position opposed to the photosensitive member 1, transfers the toner image on the photosensitive member 1 onto the transfer material by a transfer electric field of the transfer means 5. A scorotron transfer charging device, a transfer roller, a transfer blade, a transfer brush, or the like can be used as the transfer means 5. In this embodiment, a transfer roller having a semi-conductive foamed rubber layer formed on a metal shaft is used to transfer the toner image on the photosensitive member 1 onto the transfer material P by a positive transfer electric field.

The photosensitive member cleaning means 6 removes from the surface of the photosensitive member 1 a transfer residual toner that has not been transferred onto the transfer material P by the transfer means 5. A cleaning blade, a brush roller, or the like can be used as the photosensitive member cleaning means 6. In this embodiment, a cleaning blade is used, which is made of a urethane material having a durometer A hardness of 70 and a thickness of 1.5 mm.

The fixing means 10 heats and pressurizes the toner image on the transfer material P, thereby fixing the toner image onto the transfer material.

As a fixing roller 101 and a pressurizing roller 102, rollers having a metal roller on which an elastic layer made of fluororubber, silicone rubber, or the like and a surface layer made of a material exhibiting a high mold-releasing property for toner, for example, fluororesin such as PFA or PTFE, or silicone resin, being laminated can be used. A heater is provided inside the fixing roller 101 to control the temperature therein. In this embodiment, a fixing device is constituted by the fixing roller 101 and the pressurizing roller 102, each having an outer diameter of 30 mm. The fixing roller 101 and the pressurizing roller 102 are each constructed as a hollow roller made of an aluminum alloy on which an elastic layer made of silicone rubber having a thickness of 2 mm and a surface layer made of PFA having a thickness of 50 μm are laminated. A halogen lamp is arranged inside the fixing roller 101 as the heater, and a surface temperature sensor (not shown) is employed to detect and control a surface temperature.

Figure 6A:
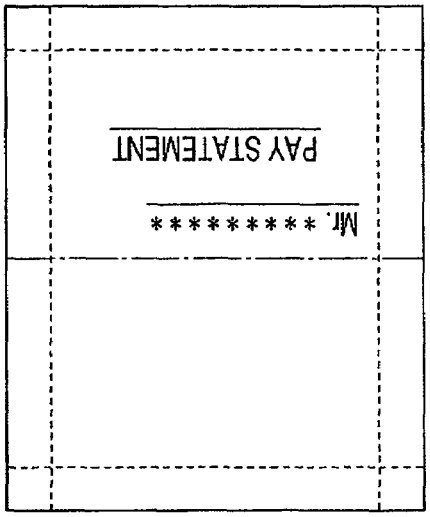
FIGS. 6A and 6B each shows the outline of a pay statement according to the second embodiment of the present invention.
Figure 6B:
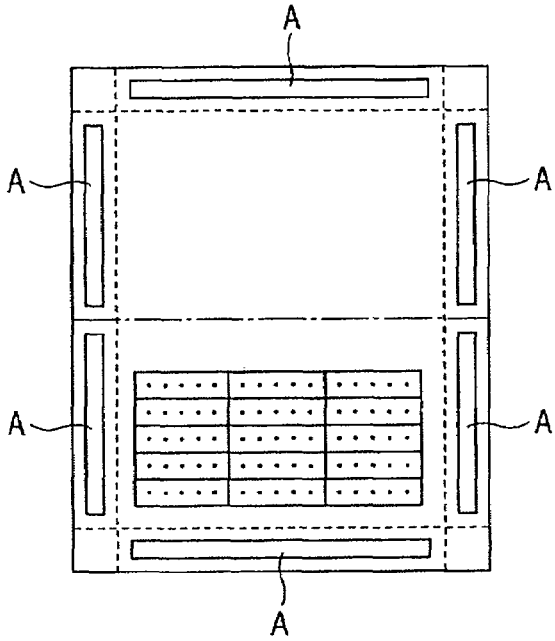
Figure 7:
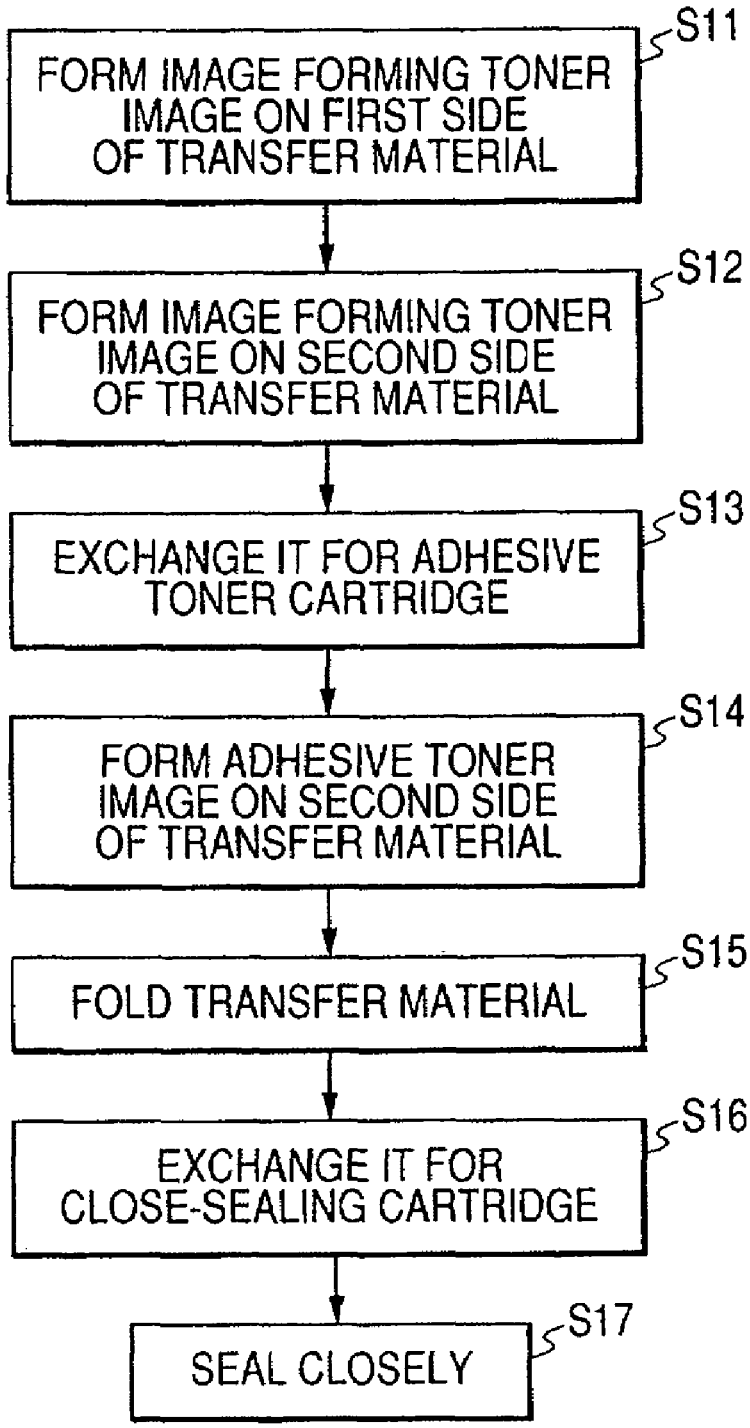
FIG. 7 is a flowchart showing the outline of an image forming method according to the second embodiment of the present invention.

Now, an image forming method in the image forming apparatus equipped with the above-mentioned automatic duplex printing mechanism will be described based on steps shown in FIG. 7, with reference to the preparation of a pay statement shown in FIGS. 6A and 6B as an example.

In a step S11, an image forming toner image is formed on the first side of the transfer material based on electronic image information. In this embodiment, an address and the like are printed (FIG. 6A). The surface temperature of the fixing roller is set to 190° C. when the image forming toner image is formed.

In a step S12, an image forming toner image is formed on the second side of the transfer material based on electronic image information. In this embodiment, the contents of a pay statement are printed (FIG. 6B).

In a step S13, a cartridge for the image forming toner is replaced with a cartridge for the adhesive toner. When the cartridge for the image forming toner has been replaced with the cartridge for the adhesive toner, the main body of the image forming apparatus reads an IC tag (not shown) provided on a side surface of the cartridge, and automatically sets the surface temperature of the fixing roller to a temperature for the adhesive toner. In this embodiment, the surface temperature of the fixing roller is set to 130° C.

In a step S14, the adhesive toner image is formed based on electronic image information. In this embodiment, the adhesive portion A is formed on the surface on which the contents of a pay statement are printed, by the adhesive toner (FIG. 6B).

In a step S15, the transfer material is folded. In this embodiment, the transfer material is manually folded along an alternate long and short dash line at the center of the pay statement such that the adhesive portion A is positioned inside.

In a step S16, the cartridge for the adhesive toner is replaced with an empty cartridge containing no toner, which is used in a sealing step. When the cartridge for the adhesive toner has been replaced with the cartridge for the sealing step, the main body of the image forming apparatus reads an IC tag (not shown) provided on a side surface of the cartridge, and automatically sets the surface temperature of the fixing roller to a temperature for the sealing step.

The optimum temperature for sealing differs depending on the required adhesive force or the heat capacity of paper, so the temperature of the fixing roller in the close sealing device 12 can be set in the control portion of the main body. In this embodiment, this temperature is set to 140° C.

In a step S17, the transfer material is sealed. The folded transfer material is passed through the image forming apparatus just as in the case of image formation and is heated by a fixing device, so the adhesive toner develops adhesiveness. The transfer material is then sealed by being pressurized.

The pay statement produced according to the above-mentioned method is adhesively sealed on the adhesive portion A, and can be opened by cutting the adhesive portion A off along perforations. The toner image produced by the image forming toner undergoes no image deterioration such as offset to an opposed face, deformation of the toner image, or the like.

Third Embodiment

Figure 8:
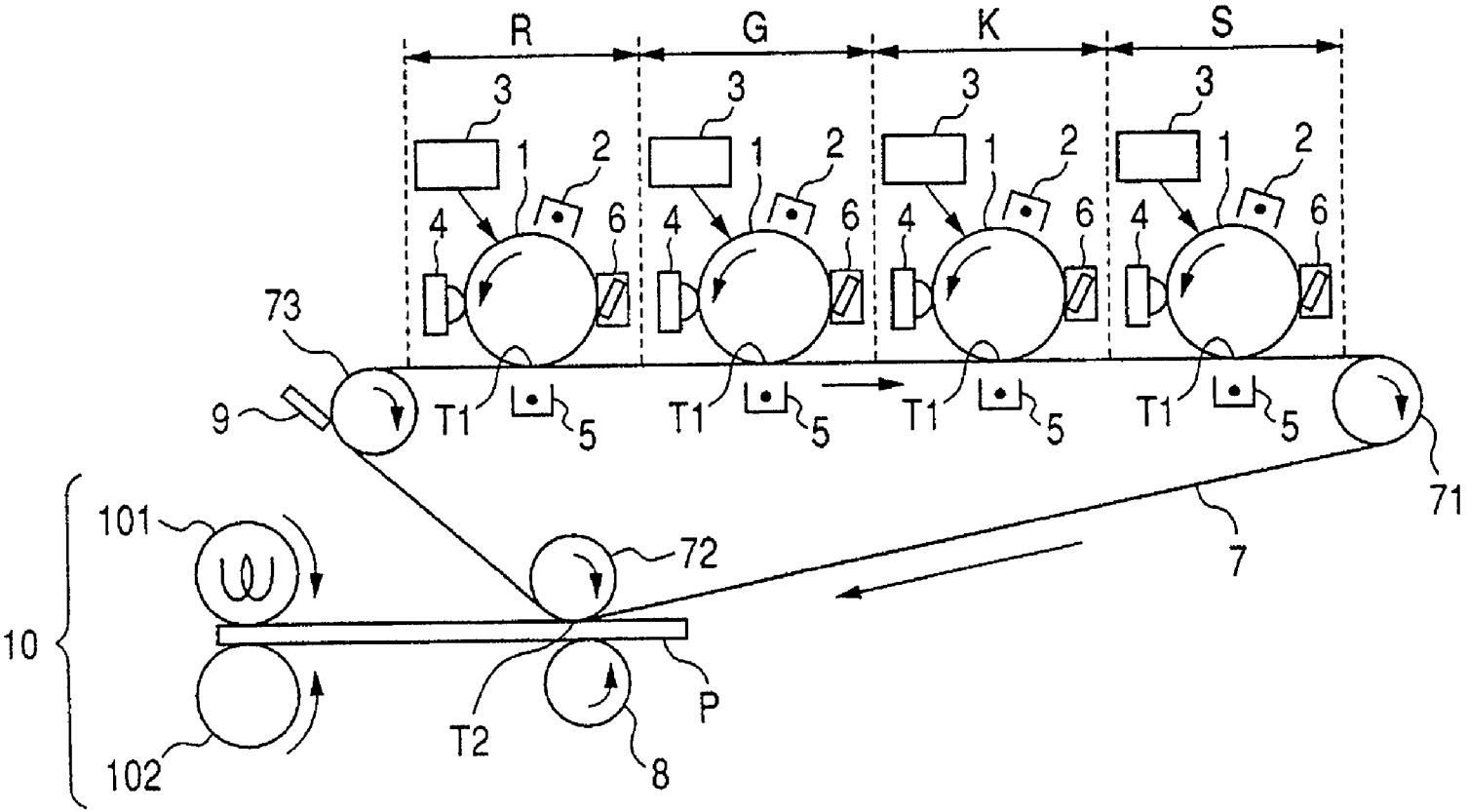
FIG. 8 is a longitudinal sectional view showing the outline of a construction of an image forming apparatus according to the third embodiment of the present invention.

FIG. 8 is a longitudinal sectional view of an example of an image forming apparatus according to the present invention.

The image forming apparatus shown in FIG. 8 is an image forming apparatus equipped with a three-color automatic duplex printing mechanism (not shown), in which four image forming units R, G, K, and S are arranged along a moving direction of an intermediate transfer belt 7 as an intermediate transfer member. A two-component nonmagnetic negative chargeable toner with an average particle diameter of 6 m is used for this image forming apparatus.

The image forming apparatus shown in FIG. 8 is provided with three image forming units for forming toner images in different colors, namely, the image forming units R, G, and K for forming special-color red, special-color green, and black toner images, respectively. The image forming apparatus is further provided with the image forming unit S for an adhesive toner. The special-color red and special-color green toners of the image forming units R and G, respectively, are prepared for strictly reproducing colors of a corporate logo. The image forming units R, G, K, and S are substantially identical in construction and operation as long as their electrophotographic processes are concerned, except that their toners are different from one another.

First of all, a toner used in this embodiment will be described. Note that, a known magnetic carrier is employed.

An image forming toner is composed of 100 parts by weight of polyester resin, 6 parts by weight of paraffin wax, 2.0 parts by weight of a known negative chargeable charge control agent, and 1.5 parts by weight of negative chargeable hydrophobic silica, and is obtained by blending known pigments in respective amounts required for maintaining the optical density of a fixed image. The black, special-color red, and special-color green toners are manufactured according to a known manufacturing method. In the image forming apparatus according to this embodiment, the image forming toner has a fixable temperature of 160° C. to 190° C. as to each of the colors.

As regards the adhesive toner, the amount of paraffin wax is increased to 12 parts by weight in order to improve a softening property at low temperatures and offset resistance at high temperatures, and the amount of negative chargeable hydrophobic silica is increased to 5.0 parts by weight in order to compensate for a deterioration in blocking resistance and a deterioration in fluidity resulting from the increase in the amount of paraffin wax and further improve offset resistance at high temperatures. The components other than the pigments are identical to those of the image forming toner. In the image forming apparatus according to this embodiment, the adhesive toner has a fixable temperature of 110° C. to 190° C.

Although the reproducibility of a latent image on the photosensitive member has deteriorated due to the increased amounts of paraffin wax and negative chargeable hydrophobic silica, there is no problem in forming an adhesive toner image on an adhesive portion of the transfer material.

Next, the construction of the image forming apparatus according to this embodiment will be described.

In each of the image forming units R, G, K, and S, reference numeral 1 denotes a photosensitive member serving as an image bearing member. The photosensitive member 1 is rotationally driven by drive means (not shown) in a direction indicated by an arrow (counterclockwise). A photoconductive layer is provided on a conductive base layer to constitute the photosensitive member 1. An organic photoconductor (OPC), an amorphous silicon photoconductor, a selenium photoconductor, or the like can be used as the photosensitive member 1. In this embodiment, an organic photoconductor (OPC) is used.

A charge means 2 uniformly charges the surface of the photosensitive member 1 to a predetermined polarity and a predetermined potential. A scorotron charging device, a charging roller, a magnetic brush, or the like can be used as the charge means 2. In this embodiment, a scorotron charging device is used to charge the photosensitive member 1 to a predetermined potential of a negative polarity.

An exposure means 3, which is provided downstream of the charge means 2 in a rotational direction of the photosensitive member 1, optically scans a surface of the photosensitive member 1 uniformly charged by the charge means 2, thereby forming an electrostatic latent image on the photosensitive member 1. A laser scanner, an LED array, or the like can be used as the exposure means 3. In this embodiment, a laser scanner is used.

A developing device 4, which is arranged downstream of the exposure means 3 in the rotational direction of the photosensitive member 1, develops the electrostatic latent image on the photosensitive member 1 by a toner. In this embodiment, the electrostatic latent image on the photosensitive member 1 is reverse-developed by the above-mentioned two-component nonmagnetic negative chargeable toner.

A primary transfer means 5, which is provided so as to be disposed opposite to the photosensitive member 1 with an intermediate transfer belt 7 interposed therebetween at a primary transfer position T1, primarily transfers a toner image on the photosensitive member 1 onto the intermediate transfer belt 7 by a transfer electric field of the primary transfer means 5. A scorotron transfer charging device, a transfer roller, a transfer blade, a transfer brush, or the like can be used as the primary transfer means 5. In this embodiment, a scorotron transfer charging device is used, and the toner image on the photosensitive member 1 is primarily transferred onto the intermediate transfer belt 7 by a positive transfer electric field.

A photosensitive member cleaning means 6 removes from the surface of the photosensitive member 1 a transfer residual toner that has not been transferred onto the intermediate transfer belt 7 by the transfer means 5. A cleaning blade, a brush roller, or the like can be used as the photosensitive member cleaning means. In this embodiment, a cleaning blade is used, which is made of a urethane material having a durometer A hardness of 70 and a thickness of 3 mm.

The aforementioned operation is performed in each of the four image forming units R, G, K, and S. A special-color red toner image formed by the image forming unit R, a special-color green toner image formed by the image forming unit G, a black toner image formed by the image forming unit K, and an adhesive toner image formed by the image forming unit S are sequentially superimposed at primary transfer portions T1 of the respective image forming units and then primarily transferred onto the intermediate transfer belt 7. Thus, an unfixed three-color toner image composed of special-color red, special-color green, and black toners is formed on the intermediate transfer belt 7. Also, the adhesive toner image is formed on the intermediate transfer belt 7.

The intermediate transfer belt 7 as an intermediate transfer member, which is suspended by a driving roller 71 and driven rollers 72 and 73 and is in contact with the photosensitive members 1 of the respective image forming units R, G, K, and S, is rotationally driven in the direction indicated by the arrow. For the intermediate transfer belt 7, a resin such as polyester, fluororesin, polyphenyl sulfide, polyamide-imide, polyimide, polyether ketone or polycarbonate can be used. As an electric resistance, the intermediate transfer belt 7 preferably exhibits a volume resistivity of $10^6$ to $10^{13}$ Ω·cm and a surface resistivity of $10^8$ to $10^{14}$ Ω/□, and more preferably exhibits a volume resistivity of $10^8$ to $10^{11}$ Ω·cm and a surface resistivity of $10^{10}$ to $10^{13}$ Ω/□. In this embodiment, an endless polyimide belt with a thickness of 90 μm, of which electric resistance has been adjusted to a volume resistivity of $10^9$ Ω·cm and a surface resistivity of $10^{11}$ Ω/□ according to a known method, is used.

A secondary transfer means 8 is provided so as to be opposed to the driven roller 72 across the intermediate transfer belt 7 at a secondary transfer position T2. The toner image on the intermediate transfer belt 7 is secondarily transferred onto a transfer material P that has been introduced from a paper feeding portion (not shown) to the secondary transfer position T2 in exact timing with the toner image on the intermediate transfer belt 7, by a transfer electric field of the secondary transfer means 8. A scorotron transfer charging device, a transfer roller, a transfer blade, a transfer brush, or the like can be used as the secondary transfer means 8. In this embodiment, a transfer roller having a semi-conductive foamed rubber layer formed on a metal shaft is used, and the toner image on the intermediate transfer belt 7 is secondarily transferred onto the transfer material P by a positive transfer electric field.

The intermediate transfer belt cleaning means 9 removes the transfer residual toner that has remained instead of being transferred onto the transfer material on the intermediate transfer belt. A cleaning roller, a cleaning blade, a cleaning web, or the like can be used as the intermediate transfer belt cleaning means 9. In this embodiment, a cleaning blade is used, which is made of a urethane material having a durometer A hardness of 75 and a thickness of 2 mm.

The fixing means 10 heats and pressurizes the toner image on the transfer material P, thereby fixing the toner image onto the transfer material.

As a fixing roller 101 and a pressurizing roller 102, rollers having a metal roller on which an elastic layer made of fluororubber, silicone rubber, or the like and a surface layer made of a material exhibiting a high mold-releasing property for toner, for example, fluororesin such as PFA or PTFE, or silicone resin, being laminated can be used. A heater is provided inside the fixing roller 101 to control the temperature therein. In this embodiment, a fixing device is constituted by the fixing roller 101 and the pressurizing roller 102, each having an outer diameter of 60 mm. The fixing roller 101 and the pressurizing roller 102 are each constructed as a hollow roller made of an aluminum alloy on which an elastic layer made of silicone rubber having a thickness of 2 mm and a surface layer made of PFA having a thickness of 50 μm are laminated. A halogen lamp is arranged inside the fixing roller 101 as the heater, and a surface temperature sensor (not shown) is employed to detect and control a surface temperature.

The two-folding device 11 and the close sealing device 12 according to the first embodiment of the present invention is connected on-line to the image forming apparatus according to this embodiment as a post-treatment device.

Figure 9B:
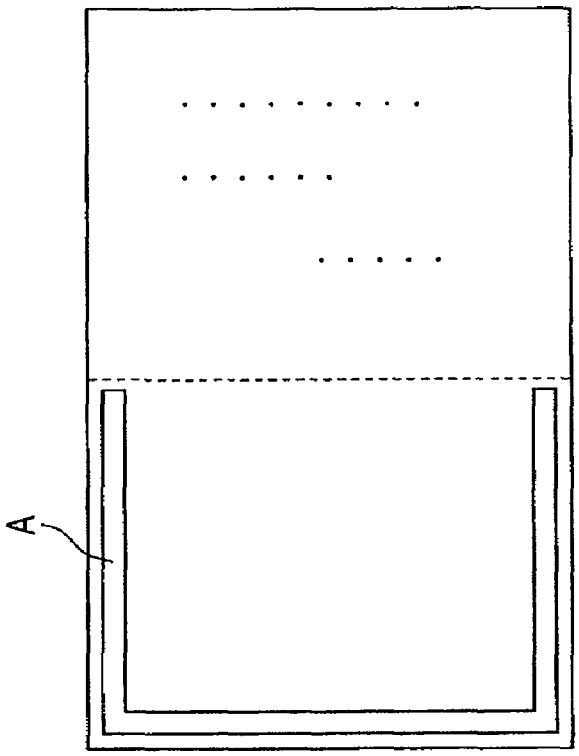
FIGS. 9A and 9B each shows the outline of a letter of appointment according to the third embodiment of the present invention.
Figure 9A:
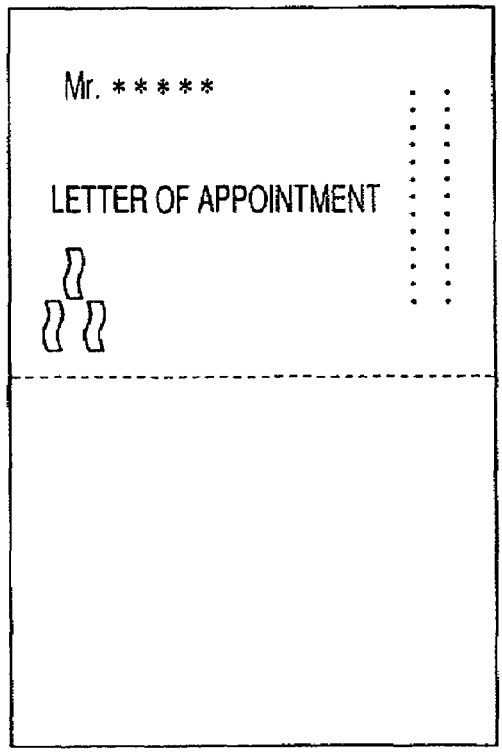

Now, an image forming method in the image forming apparatus equipped with the above-mentioned automatic duplex printing mechanism will be described based on steps shown in FIG. 4, with reference to the preparation of a letter of appointment shown in FIGS. 9A and 9B as an example.

In a step S1, an image forming toner image is formed on the first side of a transfer material based on electronic image information. In this embodiment, an address, a corporate logo with a special-color toner, and the like are printed (FIG. 9A).

In a step S2, an image forming toner image and an adhesive toner image are formed on the second side of the transfer material based on electronic image information. In this embodiment, the contents of letter of appointment are printed, and an adhesive portion A is formed by the adhesive toner (FIG. 9B).

The adhesive toner is made to exhibit the property of softening at a lower temperature than the image forming toner, but is substantially identical to the image forming toner in the property of offsetting the fixing roller at high temperatures due to the effect of the increased amounts of paraffin wax and negative chargeable hydrophobic silica. Therefore, the adhesive toner can be fixed at the same temperature of the fixing roller as the image forming toner. In this embodiment, the temperature of the fixing roller is set to 180° C.

In a step S3, the transfer material is folded. After the toner is fixed, the transfer material is conveyed to the two-folding device as described in the first embodiment of the present invention with the surface on which the adhesive toner image is formed facing downward by a surface reverse device (not shown), and then is folded such that the surface on which the adhesive toner image is formed is positioned inside. In this embodiment, the transfer material is folded along an alternate long and short dash line at the center of the letter of appointment such that the adhesive portion A is positioned inside.

In a step S4, the transfer material is sealed. The folded transfer material is conveyed to the close sealing device as described in the first embodiment of the present invention and heated, so the adhesive toner develops adhesiveness. The transfer material is then sealed by being pressurized. The temperature most suited for sealing differs depending on the required adhesive force or the heat capacity of paper, so the temperature of the fixing roller in the close sealing device 12 can be set again in a control portion of a main body. In this embodiment, this temperature is set to 105° C. which is 20° C. lower than the temperature 125° C. of the first embodiment of the present invention such that the adhesive portion A can be exfoliated.

The letter of appointment produced according to the above-mentioned method is adhesively sealed on the adhesive portion A, and can be opened by exfoliating the adhesive portion A. The toner image produced by the image forming toner undergoes no image deterioration such as offset to an opposed face, deformation of the toner image, or the like.

In this embodiment, the adhesive portion A is formed on the second side by the adhesive toner. However, it is also possible to form the adhesive toner image on the first side.

As described above, according to the present invention, the adhesive toner develops adhesiveness at a temperature equal to or lower than the temperature at which the image forming toner develops adhesiveness, so there is no need to locally heat or pressurize only the adhesive portion. As a result, a document can be sealed with a simple construction.

Further, the post-treatment devices for sealing are connected on-line to the image forming apparatus, so all the steps for producing a document requiring sealing, that is, the image forming step, the adhesive portion forming step, the paper folding step, and the sealing step can be carried out more efficiently. In addition, more complete preservation of confidentiality is guaranteed by sealing the document within the image forming system.

This application claims priority from Japanese Patent Application No. 2004-367348 filed on Dec. 20, 2004, which is hereby incorporated by reference herein.

What is claimed is:

1. An image forming method comprising the following steps in the recited order:

forming an image on a recording material using an image forming toner;

heat fixing the image on the recording material, which has been formed using the image forming toner;

forming an adhesive toner that is lower in a lower-limit temperature of a fixable temperature than the image forming toner in a position, which does not overlap with a position, in which the image of the image forming toner is formed, on the recording material; and heat fixing the adhesive toner on the recording material.

2. An image forming method according to claim 1, wherein said step of heat fixing the adhesive toner includes heating the recording material in a state in which the adhesive toner is between surfaces to be bonded, so that the surfaces interposing the adhesive toner therebetween are bonded to each other.

3. An image forming method according to claim 1, further comprising the step of:

after the forming the adhesive toner, folding the recording material so that the adhesive toner is inside the folded recording material, wherein the adhesive toner is formed lest the adhesive toner overlaps with the image forming toner in the folding.

4. An image forming method according to claim 1, further comprising the steps of:

before the forming the adhesive toner, replacing an image forming unit for forming an image using the image forming toner with an adhesive toner forming unit for forming the adhesive toner; and after the replacing the image forming unit, changing a fixing temperature.

5. An image forming method according to claim 1, further comprising the step of:

before the forming the image, providing a plurality of image forming units, one of said plurality of image forming units being an adhesive toner forming unit for forming the adhesive toner.

* * * * *

UNITED STATES PATENT AND TRADEMARK OFFICE

CERTIFICATE OF CORRECTION

PATENT NO. : 7,260,354 B2
APPLICATION NO. : 11/304814
DATED : August 21, 2007
INVENTOR(S) : Ishida It is certified that error appears in the above-identified patent and that said Letters Patent is hereby corrected as shown below:

COLUMN 2:
Line 22, “shows” should read --show--.
Line 25, “method” should read --methods--.
Line 27, “invention;” should read --invention.--.
Line 31, “shows” should read --show--.
Line 36, “invention;” should read --invention.--.
Line 39, “shows” should read --show--.

COLUMN 3:
Line 12, “long” should read --far--.
Line 15, “that,” should read --that--.
Line 26, “to” should read --do--.
Line 40, “as” should read --at--.

COLUMN 10:
Line 25, “long” should read --far--.
Line 28, “that,” should read --that--.
Line 39, “to” should read --do--.

COLUMN 13:
Line 11, “letter” should read --a letter--.

UNITED STATES PATENT AND TRADEMARK OFFICE

CERTIFICATE OF CORRECTION

PATENT NO. : 7,260,354 B2
APPLICATION NO. : 11/304814
DATED : August 21, 2007
INVENTOR(S) : Ishida It is certified that error appears in the above-identified patent and that said Letters Patent is hereby corrected as shown below:

COLUMN 14:
Line 38, "the forming" should read --forming--.
Line 46, "the forming" should read --forming--.
Line 50, "the replacing" should read --replacing--.
Line 54, "the forming" should read --forming--.

Signed and Sealed this

Thirteenth Day of May, 2008

JON W. DUDAS
*Director of the United States Patent and Trademark Office*